US005690556A

United States Patent [19]

Condon

[11] Patent Number: 5,690,556

[45] Date of Patent: Nov. 25, 1997

[54] PUTTER/CHIPPER GOLF CLUB

[76] Inventor: Dennis Paul Condon, 144 Carlyle Dr., Palm Harbor, Fla. 36483

[21] Appl. No.: 745,774

[22] Filed: Nov. 8, 1996

Related U.S. Application Data

[60] Provisional application No. 60/006,504, Nov. 9, 1995.

[51] Int. Cl.[6] ..... A63B 53/04

[52] U.S. Cl. ..... 473/252; 473/328

[58] Field of Search ..... 473/242, 251, 473/252, 253, 257, 228, 324, 327, 328, 344, 340, 341, 313

[56] References Cited

U.S. PATENT DOCUMENTS

| | | | |
|---|---|---|---|
| 1,139,738 | 5/1915 | Tyler . | |
| 1,531,821 | 3/1925 | Scott | 473/328 |
| 1,669,482 | 5/1928 | Miller | 473/328 |
| 4,832,344 | 5/1989 | Werner . | |
| 5,014,992 | 5/1991 | McCallister . | |
| 5,154,423 | 10/1992 | Antonious | 473/328 |
| 5,174,573 | 12/1992 | Desbiolies et al. . | |
| 5,193,806 | 3/1993 | Burkly . | |
| 5,294,122 | 3/1994 | Longo | 473/328 |
| 5,380,009 | 1/1995 | Henry | 473/328 |
| 5,390,924 | 2/1995 | Antonious | 473/328 |

FOREIGN PATENT DOCUMENTS

| | | |
|---|---|---|
| 6733 | 9/1980 | European Pat. Off. . |
| 364845 | 1/1932 | United Kingdom . |

*Primary Examiner*—Sebastiano Passaniti
*Attorney, Agent, or Firm*—Richard C. Litman

[57] ABSTRACT

A multi-functional golf club head, designed to be used as a putter and/or chipper, depending on the location of the golf ball. The club head includes golf ball centering indicia on a top face, an angled striking surface, and rails on a flat bottom surface. The ball centering indicia are designed to assist the golfer in aligning the golf ball with the target and the best striking area of the club head. The striking surface of the club head is angled to loft or chip the golf ball from various locations on the golf course, by employing a putting stroke. The rails allow the golfer to chip the golf ball with a smooth putting stroke over fringe grasses. The rails are blunted or curved at the front of the club head so that the head does not catch or snag on a putting surface during a putting stroke.

10 Claims, 3 Drawing Sheets

PUTTER/CHIPPER GOLF CLUB

CROSS REFERENCE TO RELATED APPLICATION

This application is based on Provisional patent application Ser. No. 60/006,504, filed Nov. 9, 1995.

BACKGROUND OF THE INVENTION

1. Field of the Invention

The present invention relates generally to a multi-functional golf club. More specifically, the invention relates to a golf club that can be used as either a putter or a chipper, depending on the location of the golf ball on the golf course. The club head of the golf club is made up of golf ball centering indicia on the top face of the club head, an angled striking surface, and rails on the bottom of the club head. The ball centering indicia are designed to assist the golfer in aligning the golf ball and the club head with a target. The striking surface of the club head is angled to loft or chip the golf ball. The rails allow the golfer to putt the golf ball smoothly and to chip the golf ball with a putting stroke, from off the green, e.g., from the first fringe.

2. Description of the Prior Art

The prior art illustrates an abundance of golf clubs. There are many different types of golf clubs. The basic types of golf clubs are woods, irons, and a putter. All three types include the basic elements of a golf club: a club head body, a shaft, and a hosel for connecting the head to the shaft. The woods and irons are used to drive the ball at distances ranging from a few yards up to 300 yards and more. The swing for the woods and irons is typically a complete swing where the club head is moving at a rapid speed. Contrary to the woods and irons, the putter is almost exclusively used for tapping the golf ball into the cup when on the green. Since putting requires accuracy and control, the typical swing for a putt is a relatively slow, pendulum like swing. The prior art fails to disclose a golf club head design which affords the ability to both chip and putt with a putting stroke. Thus, the invention may be used for chip shots from the first, and even the second fringe, by using a putting stroke, the bottom of the club being provided with rails so that the putter glides easily over fringe grass during a stroke.

U.S. Pat. No. 1,139,738 issued May 18, 1915 to Tyler, discloses an improved golf club head design for lofting a golf ball. However, the golf ball is lofted by striking the ball with the top surface of the club head, rather than the front face of the club head, as in the instant invention.

U.S. Pat. No. 4,832,344 issued May 23, 1989 to Werner, illustrates a golf club having an interchangeable runner on the bottom of the club head that is held in place with screws or double-sided adhesive tape. The runner is capable of being changed by the golfer to vary the vertical height of the clubhead in order to adjust the position of the sweet spot of the club face. However, the clubhead as illustrated has a single runner and the runner is not integral to the design of the clubhead. The instant invention has two integral runners.

U.S. Pat. No. 5,014,992 issued May 14, 1991 to McCallister, discloses a putter that provides visual cues to the golfer. U.S. Pat. No. 5,174,573 issued Dec. 29, 1992 to Desbiolies et al., illustrates a putter having ball-centering indicia with a curvilinear reference located on the upper surface of the clubhead and tangent to the edge. The instant invention is distinguishable from each of these references, in that it has rails on its bottom surface.

U.S. Pat. No. 5,193,806 issued May 16, 1993 to Burkly, shows a right circular cylindrically shaped golf clubhead that can be used for chipping and putting a golf ball. The instant invention is distinguishable, in that it discloses a clubhead having a semi-circular cross-section, and rails on its bottom surface.

British Pat. No. 364,845 issued Jan. 14, 1932 to Marsh, describes a wooden club head having a transverse rib attached to the base of the club head. The rib extends across the bottom of the club head from the front of the club head to the rear. The depth of the rib gradually increases from face to rear, being flush with the base at the face and of maximum depth at the rear. The instant invention is distinguishable as a metal club head having at least two rails that decrease in depth from face to rear and are an integral part of the clubhead.

European Patent Application No. 6,733 issued Sep. 1, 1980 to Crow, shows a wooden golf club head incorporating a metal sole plate with a pair of spaced runners. The runners are semi-circular in cross section and extend from the face of the clubhead to the rear with a constant depth. The instant invention is distinguishable, in that it discloses a metal club head having runners integral to the clubhead and having a varying depth.

None of the above inventions and patents, taken either singly or in combination, is seen to describe the instant invention as claimed.

SUMMARY OF THE INVENTION

The present invention is a multi-functional golf club head. The club head is designed to be used as a putter and chipper, depending on the location of the golf ball on the golf course. Chipping and putting are vital components of the game of golf. The essence of being able to chip and putt competently is to control the motion of the golf ball while it is rolling and bouncing toward the cup. The design and configuration of a club head is therefore critical in enabling a golfer to maximize control of the golf ball. In the present invention, the club head is made up of golf ball centering indicia on the top face, an angled striking surface, and rails on the bottom of the club head. The ball centering indicia is designed to assist the golfer in aligning the golf ball and the club head with a target. The striking surface of the club head is angled to loft or chip the golf ball from various locations on the golf course. The rails allow the golfer to putt the golf ball smoothly over fringe grass and the forward edges of the rails are blunted and gently curved so that the club head will not bite into or be caught on the green when putting.

Accordingly, it is a principal object of the invention to provide a single golf club head capable of being used for both chipping and putting.

It is another object of the present invention to have a club head having ball centering indicia to align the golf ball with the target and the best striking area of the club head.

It is a further object of the present invention to have a club head with an angled striking surface for lofting or chipping the golf ball from various locations on the golf course.

It is a further object of the present invention to have a club head with rails on the bottom of the club head to allow the golfer to chip and putt the ball smoothly.

It is a further object of the present invention to have a club head configured for ball control by the golfer.

It is a further object of the present invention to have a club head permitting the golfer to use one club for various situations.

It is a further object of the present invention to have a club head that speeds up a golfer's game because there are fewer decisions to be made and fewer trips back to the golf bag for a change of club selection.

It is a further object of the present invention to have a club head provide the added advantage of not having to remember to pick up clubs used for chipping when leaving the green after putting.

It is an object of the invention to provide improved elements and arrangements thereof in an apparatus for the purpose described which is inexpensive, dependable and fully effective in accomplishing its intended purposes.

These and other objects of the present invention will become readily apparent upon further review of the following specification and drawings.

DETAILED DESCRIPTION OF THE PREFERRED EMBODIMENT

Figure 1:
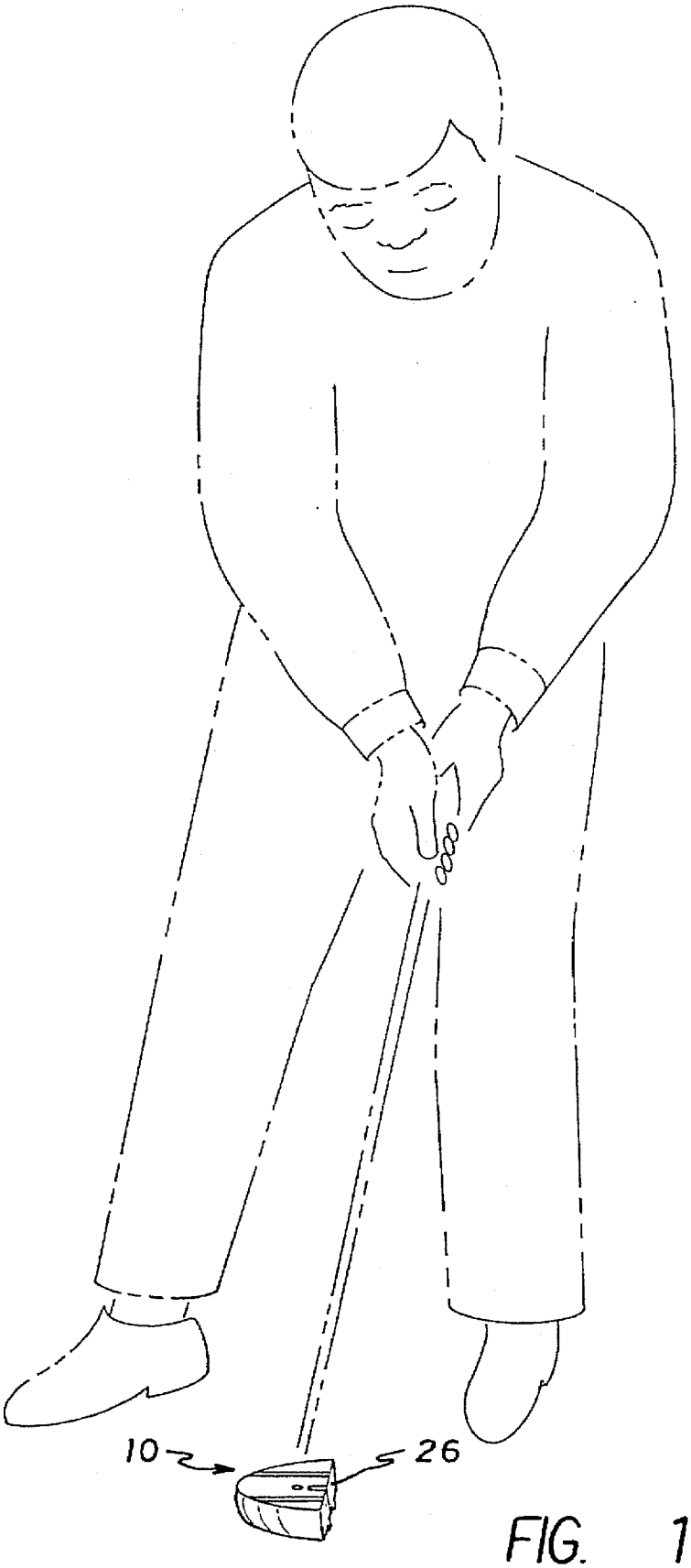
FIG. 1 is a general view of a golfer using a golf club with the putter/chipper club head, having rails designed and configured according to the present invention, an angled striking surface and golf ball aiming indicia according to the present invention thereon.
Figure 2:
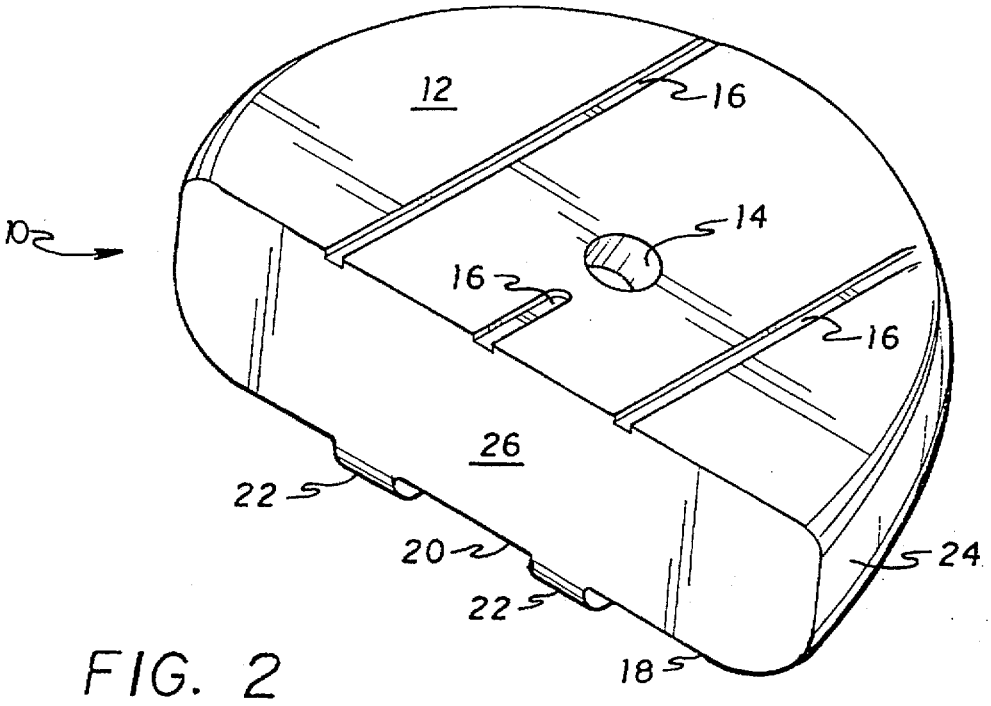
FIG. 2 is a perspective view of the putter/chipper club head of FIG. 1, drawn to an enlarged scale.
Figure 5:
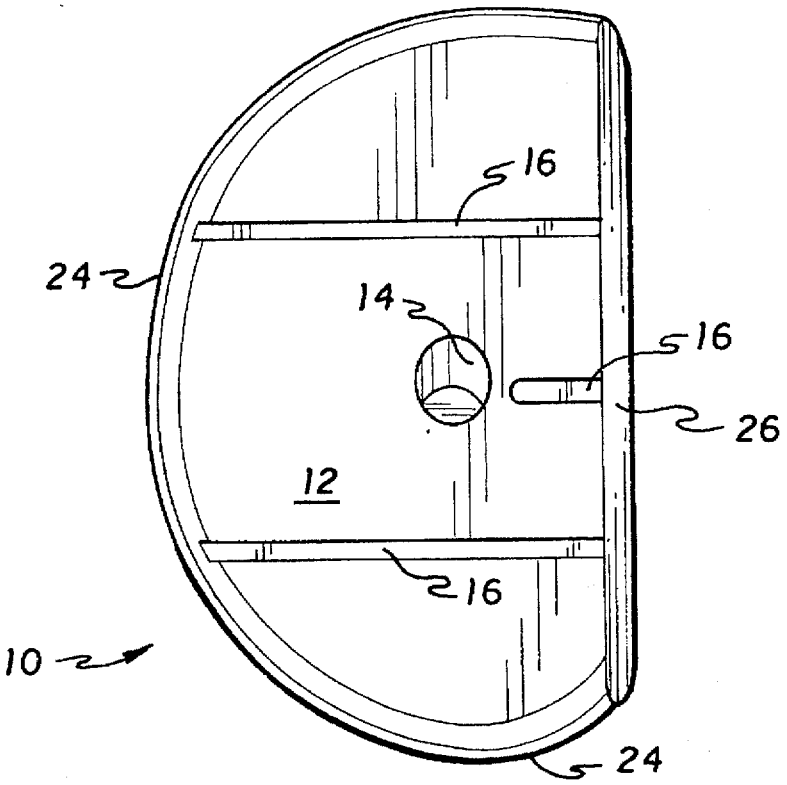
FIG. 5 is a top plan view of the present invention.

Referring to FIGS. 1 and 2, the preferred embodiment of the chipping and putting golf club head 10 is shown. The club head 10 is intended for use with a golf club shaft, a shaft ferrule and a gripping device. The club head 10 has an angled striking surface 26 for lofting or chipping the golf ball. The club head 10 also has a top surface 12 with a shaft receiving hole 14 and ball centering indicia 16. The bottom surface 18 of the club head 10 has a central groove 20 and rails 22. As can also be seen by FIGS. 2, 5 and 6, the club head 10 has a semi-oval shape. The angled striking surface 26 makes up the front of the club, while the semi-oval shape of the club head body is defined by the back surface 24.

Referring further to FIG. 2, it can be seen that the club head 10 is designed and configured to strike a golf ball. The club head has a top surface 12 with a shaft receiving hole 14 that receives the end of a standard golf club shaft. The shaft is held in the shaft receiving hole 14 by a shaft ferrule and an adhesive in a manner well known in the art. The top surface 12 of the club head 10 also has ball centering indicia 16 that allow a golfer to align a golf ball and the club head 10 with a target.

Figure 3:
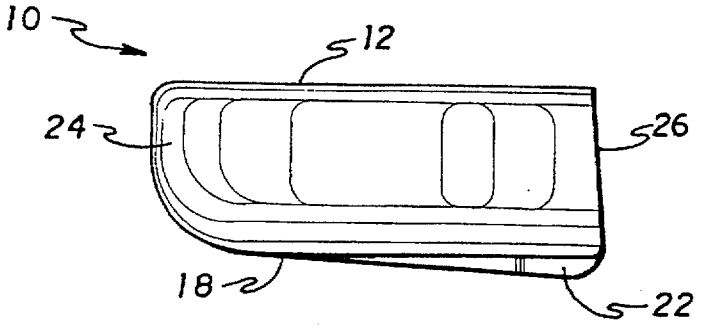
FIG. 3 is a side elevational view of the present invention.

The club head 10 has an angled striking surface 26. As best seen in FIG. 3, the striking surface 26 is angled to loft or chip a golf ball while employing a putting stroke, as well as allow a more positive roll of the golf ball when putting on a green. In use, the angle of the striking surface 26 may be adjusted by the golfer by changing the grip of the golf club, or moving the club head 10 forward or aft in the stance of the golfer. In FIG. 3, the angled striking surface 26 is 4 degrees from the vertical plane, but it is to be understood that it is not limited to this.

Figure 4:
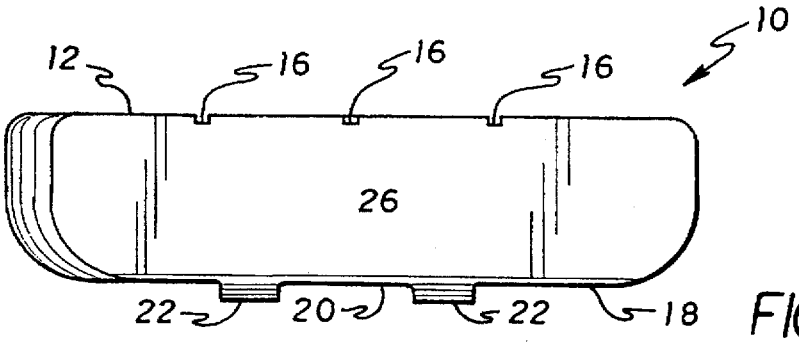
FIG. 4 is a front elevational view of the present invention.
Figure 6:
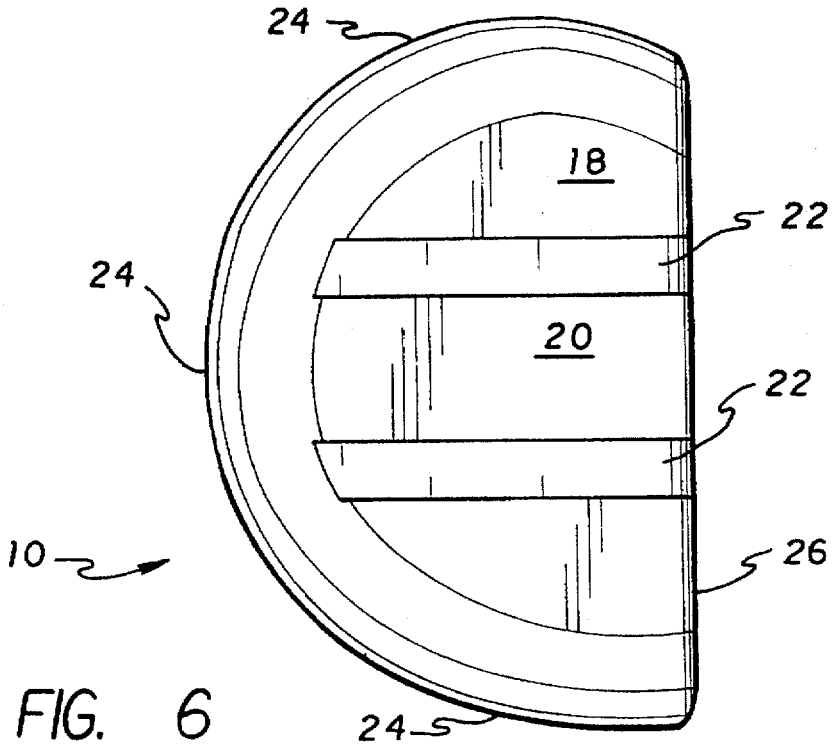
FIG. 6 is a bottom plan view of the present invention.

As represented by FIGS. 3, 4 & 6, the bottom surface 18 of the club head 10 has a pair of raised rails 22 around a central groove 20. As can be seen in FIG. 3, the rails 22 decrease in height from the angled striking surface 26 to the back surface 24. FIGS. 4 and 6 show the rails 22 in parallel relation with each other. The rails 22 and central groove 20 are designed and configured to allow the golfer to chip with a putting stroke in areas not normally conducive to putting, e.g., from the first fringe and even from the second fringe. But the bottom surface 18 and the central groove 20 are flat and coplanar, thus meeting the standards of the United States Golfing Association, which prohibit any concavity.

Additionally, and as can be best appreciated from FIGS. 2 and 3, the forward edges of the rails 22 are blunted or gently curved. This feature assures that the forward edge of the head 10 will not become caught or hung up on the putting surface when putting on a green, or snagged on fringe grass when chipping with a putting stroke.

The embodiment of the invention shown in the drawings is designed and configured for a right handed golfer, as can be appreciated from an inspection of FIG. 1. Of course, the invention may also be constructed for left handed golfers; the head 10 shown is simply made in mirror image fashion to produce a golf club head for left handed golfers.

It is to be understood that the present invention is not limited to the sole embodiment described above, but encompasses any and all embodiments within the scope of the following claims.

I claim:

1. A golf club head, comprising:

a top surface, having a shaft receiving hole;

a flat bottom surface, an angled striking surface extending between the top surface and the bottom surface, said angled surface being flat and at an acute angle with the bottom surface;

a back surface; and at least two rails extending from the flat bottom surface, with the rails being integral with the golf club head, and decreasing in height from the angled striking surface to the back surface;

whereby when said golf club head is provided with a shaft, a shaft ferrule, and a gripping device, the golf club head can be used for both chipping and putting a golf ball, with the angled striking surface allowing a more positive roll of the golf ball while putting, and said rails allowing putting in areas not normally conducive to putting.

2. A golf club head according to claim 1, further comprising ball centering indicia on the top surface of the golf club head, whereby the indicia allow a golfer to align a golf ball and said golf club head with a target.

3. A golf club head according to claim 2, wherein the golf club head is a solid body, defined by the top surface, the angled striking surface, the bottom surface, and the back surface, and said golf club head has a substantially semi-oval configuration in plan view.

4. A golf club head according to claim 3, wherein the back surface intersects with the top surface and the bottom surface at rounded edges.

5. A golf club head according to claim 4, wherein the rails are parallel.

6. A golf club head according to claim 5, wherein there are two rails.

7. A golf club head according to claim 6, wherein the rails extend from the bottom surface in a direction perpendicular to the bottom surface.

8. The golf club head according to claim 7, wherein the rails decrease in height evenly and continuously from the angled striking surface to the back surface, with the exception that ends of the rails adjacent to the angled striking surface are blunted.

9. The golf club head according to claim 8, wherein the angled surface is at an eighty-six degree angle with the bottom surface.

10. The golf club head according to claim 9, in combination with a shaft, a shaft ferrule, and a gripping device.

* * * * *